United States Patent [19]

Okutsu et al.

[11] Patent Number: 5,039,591

[45] Date of Patent: Aug. 13, 1991

[54] METHOD FOR PROCESSING SILVER HALIDE PHOTOGRAPHIC MATERIALS

[75] Inventors: Eiichi Okutsu; Tetsuro Kojima, both of Kanagawa, Japan

[73] Assignee: Fuji Photo Film Co., Ltd., Kanagawa, Japan

[21] Appl. No.: 476,908

[22] Filed: Feb. 8, 1990

[30] Foreign Application Priority Data

Feb. 8, 1989 [JP] Japan ..... 1-29418

[51] Int. Cl.[5] ..... G03C 5/24

[52] U.S. Cl. ..... 430/264; 430/265; 430/487

[58] Field of Search ..... 430/264, 265, 487

[56] References Cited

U.S. PATENT DOCUMENTS

| | | | |
|---|---|---|---|
| 2,618,558 | 11/1952 | Vittum et al. . | |
| 2,892,715 | 6/1959 | Hunsberger . | |
| 4,075,014 | 2/1978 | Gerhardt | 430/487 |
| 4,269,929 | 5/1981 | Nothnagle | 430/264 |
| 4,699,868 | 10/1987 | Sabongi | 430/264 |
| 4,740,452 | 4/1988 | Okutsu | 430/265 |
| 4,756,997 | 7/1988 | Marchesano | 430/264 |

FOREIGN PATENT DOCUMENTS

| | | | |
|---|---|---|---|
| 0032456 | 7/1981 | European Pat. Off. | 430/264 |
| 0164120 | 12/1985 | European Pat. Off. | 430/265 |
| 0203521 | 3/1986 | European Pat. Off. | 430/265 |
| 0324391 | 7/1989 | European Pat. Off. . | |
| 61-230145 | 10/1986 | Japan . | |
| 63-142349 | 6/1988 | Japan . | |
| 8707039 | 11/1987 | PCT Int'l Appl. | 430/264 |

OTHER PUBLICATIONS

GP 5976 5, vol. 11, No. 68 (P-553) [2515], Feb. 28, 1987, Application No. 60-71493.

GP 5976 7, vol. 12, No. 401 (P-776) [3248], Oct. 25, 1988, Application No. 61-289918.

*Primary Examiner*—Hoa Van Le

*Assistant Examiner*—Thomas R. Neville

*Attorney, Agent, or Firm*—Sughrue, Mion, Zinn, Macpeak & Seas

[57] ABSTRACT

A method for processing an image-wise exposed silver halide photographic material is disclosed, which comprises developing said exposed silver halide photographic material in the presence of a hydrazine derivative, wherein the processing is effected with a water-soluble alkaline developing solution having a pH of 10.5 to 12.3 and containing the following components (1) to (3):

(1) a dihydroxybenzene developing agent;

(2) a sulfite preservative in an amount of 0.3 mol/l or more; and (3) a compound represented by formula (X) in an amount of from 0.005 to 0.30 mol/l:

(X)

wherein $R_1$ represents a hydroxylalkyl group having from 4 to 10 carbon atoms, and in a preferred embodiment, using as a developing agent a dihydroxybenzene developing agent and, as an auxiliary developing agent, a p-aminophenol developing agent, a 3-pyrazolidone developing agent or a mixture thereof.

8 Claims, No Drawings

METHOD FOR PROCESSING SILVER HALIDE PHOTOGRAPHIC MATERIALS

FIELD OF THE INVENTION

The present invention relates to a method for developing a silver halide photographic material with high contrast. More particularly, the present invention relates to a method for forming high contrast negative images suited for the photomechanical process in graphic arts printing.

BACKGROUND OF THE INVENTION

In the graphic arts field an image formation system which provides a high contrast photographic property is required to achieve improved reproduction of line images or continuous gradation images formed of half tone dots.

For this purpose, a special developing solution, called a lith developer, has heretofore been used. A lith developer comprises hydroquinone alone as a developing agent. In order to prevent the inhibition of the effect of infectious development, a lith developer contains a sulfite as a preservative in the form of an adduct with formaldehyde so that the concentration of free sulfite ions is extremely low. Therefore, this is seriously disadvantageous because a lith developer is extremely subjected to air oxidation and cannot be stored for more than 3 days.

The method for providing a high contrast photographic property with a stable developing solution as described in U.S. Pat. Nos. 4,224,401, 4,168,977, 4,166,742, 4,311,781, 4,272,606, 4,211,857 and 4,243,739 proposes the use of a hydrazine derivative. In accordance with this method, photographic properties with a high contrast and a high sensitivity can be obtained, and a high concentration of sulfite can be present in the developing solution. Therefore, the stability of the developing solution to air oxidation can be drastically improved from that of a lith developer.

However, the above-mentioned method comprising the use of a hydrazine derivative is disadvantageous in that the pH value of the developing solution is higher than that used in a conventional lith developer and it tends to fluctuate. This results in uneven photographic properties.

In order to overcome these difficulties, U.S. Pat. No. 4,269,929 proposes that an amino compound be incorporated in an alkaline developing solution comprising a dihydroxybenzene developing agent and a 3-pyrazolidone developing agent to improve the activity of the developing solution, whereby a hydrazine derivative can easily provide a higher contrast and exhibit the effect of sensitization with a developing solution yet having a low pH value.

However, even in this process, the pH value of the developing solution cannot be lowered to such an extent that it does not fluctuate under the ordinary conditions of storage or use.

Furthermore, an amino compound acts as a solvent for silver halide. (For further details, reference can be made to C. E. K. Mees, *The Theory of the Photographic Process,* 3rd Ed., p. 370, and L. F. A. Mason, *Photographic Processing Chemistry,* p. 43.) Therefore, the development process described in the above cited U.S. patent which comprises the use of a large amount of an amino compound tends to result in a disadvantage called silver stain in the art. In a process which comprises supplying a replenisher into a development tank, dependent on the area of a silver halide photographic film being developed in e.g., an automatic developing apparatus, silver stain means a disadvantageous phenomenon in which after use for a long period of time the developer releases silver halide by elution which is then deposited and attached to the tank walls of the automatic developing apparatus or rollers for conveying the film in the form of silver which is later transferred to the film to be subsequently developed.

In order to eliminate silver stain, a compound which exhibits an effect of providing a high contrast but does not act as a solvent for silver halide must be used. However, compounds suitable for this purpose are not known.

In the course of the preparation of film for a printing plate, a so-called block copy or a silver halide photographic material comprising a paper support, e.g., a light-sensitive material for photographic processing (hereinafter referred to as a "photographic printing paper") is used besides the above-mentioned superhigh contrast light-sensitive material. (Paper supports herein include a so-called resin-coated paper comprising a paper coated with polyolefin on one or both sides thereof.)

These light-sensitive materials have heretofore been processed with their exclusive developing solutions. However, the installation of numerous automatic developing machines corresponding to the number of the kinds of the light-sensitive materials to be processed requires great expense.

It has therefore been desired to process the light-sensitive material comprising a paper support and the superhigh contrast light-sensitive material suitable for photographing line or half tone images with the same developing solution.

However, it was found that the use of a large amount of the above-mentioned amino compound results in the development of color stain due to the penetration of the developing solution through a cut edge in the silver halide light-sensitive material comprising a paper support. It has therefore been desired to provide a compound which exhibits the effect of providing a high contrast but eliminates color stain on a photographic paper. However, compounds suitable for this are not known.

SUMMARY OF THE INVENTION

Therefore, an object of the present invention is to provide a method for forming high contrast negative images with a hydrazine derivative which provides photographic images with little silver stain.

Another object of the present invention is to provide a method which enables photographic papers to be processed with the same developing solution with little color stain thereon.

These and other objects of the present invention will become more apparent from the following detailed description and examples.

The objects of the present invention are accomplished by a method for processing an imagewise exposed silver halide photographic material which comprises developing the exposed silver halide photographic material in the presence of a hydrazine derivative, wherein the processing is effected with a water-soluble alkaline developing solution having a pH of 10.5 to 12.3 and containing the following components (1) to (3):

(1) a dihydroxybenzene developing agent;

(2) a sulfite preservative in an amount of 0.3 mol/l or more; and (3) a compound represented by formula (X) in an amount of from 0.005 to 0.30 mol/l:

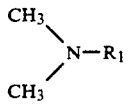

(X)

wherein $R_1$ represents a hydroxylalkyl group having from 4 to 10 carbon atoms.

DETAILED DESCRIPTION OF THE INVENTION

In the present method for the formation of images, a dihydroxybenzene (type) developing agent is used as a developing agent. In addition, a p-aminophenol (type) developing agent or 3-pyrazolidone (type) developing agent is preferably used as an auxiliary developing agent.

Examples of suitable dihydroxybenzene (type) developing agents which can be used in the present invention include hydroquinone, chlorohydroquinone, bromohydroquinone, isopropylhydroquinone, methylhydroquinone, 2,3-dichlorohydroquinone, 2,3-dibromohydroquinone, and 2,5-dimethylhydroquinone. Particularly preferred of these compounds is hydroquinone.

Examples of 1-phenyl-3-pyrazolidone and derivatives thereof which can be used as auxiliary developing agents include 1-phenyl-3-pyrazolidone, 1-phenyl-4,4-dimethyl-3-pyrazolidone, 1-phenyl-4-methyl-4-hydroxyl-methyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, and 1-p-tolyl-4,4-dimethyl-3-pyrazolidone. Particularly preferred of these compounds is 1-phenyl-4-methyl-4-hydroxylmethyl-3-pyrazolidone.

Examples of suitable p-aminophenol auxiliary developing agents include N-methyl-p-aminophenol, p-aminophenol, N-(β-hydroxyethyl)-p-aminophenol, N-(4-hydroxyphenyl)glycine, 2-methyl-p-aminophenol, and p-benzylaminophenol. Particularly preferred of these compounds is N-methyl-p-aminophenol.

In general, the dihydroxybenzene (type) developing agent is preferably present in an amount of from 0.05 to 0.8 mol/l. When a combination of dihydroxybenzenes and 1-phenyl-3-pyrazolidones and/or p-aminophenols is used, the dihydroxybenzene is preferably present in an amount of from 0.05 to 0.5 mol/l (particularly preferably from 0.20 to 0.5 mol/l) and the 1-phenyl-3-pyrazolidone and/or p-aminophenol is preferably present in an amount of 0.06 mol/l or less (particularly preferably 0.02 mol/l or less).

Examples of sulfite preservatives which can be used in the present invention include sodium sulfite, potassium sulfite, lithium sulfite, sodium bisulfite, potassium metabisulfite, and sodium formaldehyde bisulfite. The sulfite is present in an amount of 0.3 mol/l or more and preferably from 0.5 to 0.8 mol/l. However, if the sulfite is used in too large an amount, it precipitates, causing contamination in the solution. Therefore, the upper limit of the amount of the sulfite to be used is preferably 1.2 mol/l.

Specific examples of suitable amino compound represented by formula (X) include 4-dimethylamino-1butanol, 1-dimethylamino-2-butanol, 1-dimethylamino-2hexanol, 5-dimethylamino-1-pentanol, 6-dimethylamino-1-hexanol, 1-dimethylamino-2-octanol, 6-dimethylamino-1,2-hexanediol, 8-dimethylamino 1-octanol, 8-dimethylamino-1,2-octanediol, and 10-dimethylamino-1,2-decanediol. Preferred of these compounds is 6-dimethylamino-1-hexanol.

Unlike other amino compounds, the amino compounds represented by formula (X) exhibit excellent properties in that they provide remarkably high contrast when present in a small amount and do not act very strongly as silver halide solvents, with no silver stain resulting.

The amino compounds used in the present invention exhibit another excellent property in that they do not cause any color stain on a silver halide photographic material comprising a paper as a support.

The amino compound represented by formula (X) is preferably present in an amount of from 0.005 to 0.30 mol/l and particularly preferably from 0.01 to 0.2 mol/l per liter of developing solution.

The amino compound represented by formula (X) has a relatively low solubility in a developing solution (water). Therefore, when an attempt is made to concentrate the developing solution in order to reduce the volume thereof for the purpose of storage or transport, the amino compound of the formula (X) is often precipitated. However, when a compound represented by formula (Y) and (Z) shown below is used in combination with the amino compound of the formula (X), any precipitation, can be advantageously prevented even if the solution is concentrated.

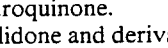

$R_5—SO_3M$ (Y)

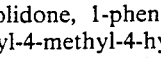

$R_6—COOM$ (Z)

wherein M represents H, Na, K or $NH_4$; and $R_5$ and $R_6$ each represents an alkyl group or an alkylbenzene group containing 3 or more carbon atoms (preferably from 4 to 15 carbon atoms) in the alkyl group or the alkyl moiety or a benzene group.

Specific examples of compounds represented by formula (Y) include sodium p-toluenesulfonate, sodium benzenesulfonate, and sodium 1-hexasulfonate. Preferred of these compounds is p-toluenesulfonate. Specific examples of compounds represented by formula (Z) include sodium benzoate, sodium p-toluiate, potassium isobutylate, sodium n-caproate, sodium n-caprylate, and sodium n-caprylate. Preferred of these compounds is sodium n-caprylate.

The amount of the compound of the formula (Y) or (Z) used depends on the amount of the compound of the formula (X) but is normally in the range of 0.005 mol/l-developing solution or more, particularly preferably from 0.03 to 0.2 mol/l-developing solution, or preferably in the range of from 0.5 to 20 mol and more preferably from 0.5 to 10 mol, per mol of amino compound of the formula (X).

The developing solution of the present invention can contain an alkaline agent such as sodium hydroxide, potassium hydroxide, sodium carbonate, potassium carbonate, tribasic sodium phosphate, tribasic potassium phosphate, sodium silicate, and potassium silicate as a pH adjustor or buffer to adjust the pH value to from 10.5 to 12.3 and preferably from 10.7 to 12.0.

The preferred alkaline agents are potassium hydroxide and tribasic potassium phosphate.

Examples of additives which can be present in addition to the above-mentioned components include antifoggants or black pepper inhibitors such as boric acid, borax), development inhibitors (e.g., sodium bromide, potassium bromide, potassium iodide), organic solvents (e.g., ethylene glycol, diethylene glycol, triethylene glycol, dimethylformamide, methyl cellosolve, hexylene glycol, ethanol, methanol), mercapto compounds (e.g., 1-phenyl-5-mercaptotetrazole, sodium 2-mercaptobenzimid-azole-5-sulfonate), indazole compounds (e.g., 5-nitro-indazole), and benztriazole compounds (e.g., 5-methyl-benztriazole). The developing solution used in the present invention further may optionally contain a color toner, a surface active agent, an defoaming agent, a hard water softening agent, a film hardener, and the like.

The developing solution to be used in the present invention may comprise a compound as described in JP-A-56-24347 (The term "JP-A" as used herein means an "unexamined published Japanese patent application") as a silver stain inhibitor, a compound as described in JP-A-62-212651 as a development evenness inhibitor, and a compound as described in JP-A-61-267759 as a dissolution aid.

The developing solution to be used in the present invention may comprise buffer such as boric acid as described in JP-A-62-186259, saccharides (e.g., saccharose) as described in JP-A-60-93433, oximes (e.g., acetoxime), phenols (e.g., 5-sulfosalicylic acid), or tribasic phosphate (e.g., sodium salt, potassium salt).

The developing temperature to be used in the present invention is generally from 20° to 50° C. and preferably from 25° to 43° C.

The developing time to be used in the present invention is generally from 10 seconds to 4 minutes and preferably from 10 seconds to 60 seconds.

After the development processing, the photographic material is subjected to a fixing. The fixing solution to be used in the present invention is an aqueous solution containing a fixing agent and optionally a film hardener (e.g., a water-soluble aluminum compound), acetic acid and a dibasic acid (e.g., tartaric acid, citric acid, and salts thereof). The fixing solution preferably has a pH value of 3.8 or more and more preferably from 4.0 to 5.5.

Examples of suitable fixing agents include sodium thiosulfate or ammonium thiosulfate. From the standpoint of fixing speed, ammonium thiosulfate is particularly preferred. The amount of the fixing agent present may be appropriately selected but is normally in the range of from about 0.1 to about 5 mol per liter of the fixing solution.

The water-soluble aluminum salt which acts mainly as a film hardener in the fixing solution is a compound commonly known as a film hardener for an acidic film hardening fixing solution. Examples of suitable film hardeners include aluminum chloride, aluminum sulfate, and potassium alum.

Examples of the above-mentioned dibasic acids include tartaric acid or derivatives thereof, or citric acid or derivatives thereof, which can be used singly or in combination. The effective amount of such a compound is in the range of generally 0.005 mol or more and particularly from 0.01 to 0.03 mol per liter of the fixing solution.

Specific examples of suitable debasic acids include tartaric acid, potassium tartrate, sodium tartrate, potassium sodium tartrate, ammonium tartrate, and potassium ammonium tartrate.

Examples of citric acid or derivatives thereof which can be effectively used in the present invention include citric acid, sodium citrate, and potassium citrate.

The fixing solution further may optionally contain a preservative (e.g., sulfite, bisulfite), a pH buffer (e.g., acetic acid, boric acid), a pH adjustor (e.g., ammonia, sulfuric acid), an image preservability improver (e.g., potassium iodide), and a chelating agent. A pH buffer is present in an amount of from 10 to 40 g/l and preferably from 18 to 25 g/l, because the developing solution has a high pH value.

In the development procedure, the temperature and time for fixing are preferably in the range of from about 20° to about 50° C. and from 10 seconds to 1 minute, respectively.

After fixing, a washing and/or stabilization is performed. The washing water may contain an antimold agent as described in Horiguchi, *Bokin Bobai no Kaqaku,* and JP-A-62-115154, a washing accelerator (e.g., sulfite), a chelating agent, or the like.

The replenishment rate for the washing water may be 1,200 ml/m$^2$ or less (0 inclusive).

Where the replenishment rate of the washing water (or stabilizing solution) is 0 means that the washing is effected in a water reserve process. As a means to minimize the replenishment rate, a multistage countercurrent process (comprising 2 or 3 stages) is well known.

If some difficulties arise from the use of a small replenishment rate of washing water, the following approaches can be used in combination therewith to provide excellent processing properties.

The washing bath or stabilizing bath may use as a microbiocide an isothiazoline (type) compound as described in R. T. Kreiman, *J. Image. Tech.,* Vol. 10, No. 6, page 242 (1984), *Research Disclosure,* Vol. 205, No. 20526 (May 1981), and *Research Disclosure,* Vol. 228, No. 22845 (April 1983), and compounds as described in JP-A-61-115154 and JP-A-62-209532. Furthermore, the washing bath or stabilizing bath may contain a compound as described in Hiroshi Horiguchi, *Bokin Bobai no Kaqaku,* Sankyo Shuppan (1982), *Bokin Bobai Gijutsu Handbook,* Nihon Bokin Bobai Gakkai (Hakuhodo) (1986), L. E. West, "Water Quality Criteria", *Photo. Sci. & Eng.,* Vol. 9, No. 6 (1965), M. W. Beach, "Microbiological Growths in Motion Picture Processing", *SMPTE Journal,* Vol. 85 (1976), and R. O. Deegan, "Photo Processing Wash Water Biocides", *J. Imaging Tech.,* Vol. 10, No. 6 (1984).

In the present process, if a small amount of washing water is used, a squeeze roller washing bath and a cross over rack washing bath as described in JP-A-63-18350 and JP-A-62-287252 may be advantageously employed.

Furthermore, the overflow solution from the washing bath or stabilizing bath caused by the replenishment with water containing an antimold agent can be entirely or partially reused as a processing solution having a fixing effect for the previous processing as described in JP-A-60-235133 and JP-A-63-129343. Moreover, in order to prevent foaming which is easily developed when a small amount of washing water is used and/or prevent the transfer of processing agent components attached to the squeeze roller to a film thus processed, a water-soluble surface active agent or defoaming agent may be incorporated in the washing bath or stabilizing bath.

In order to inhibit the stain with a dye eluted from the light-sensitive material, a dye adsorbent as described in JP-A-63-163456 may be incorporated in the washing bath.

In accordance with the above-mentioned method, the light-sensitive material thus developed and fixed is then washed with water and dried. The washing is effected to remove silver salts dissolved upon fixing almost completely. The washing is preferably effected at a temperature of from about 20° to about 50° C., for from 10 seconds to 3 minutes. The drying is effected at a temperature of from about 40° to about 100° C. The drying time can be appropriately selected depending on the ambient conditions but is normally in the range of from about 5 seconds to 210 seconds.

An automatic developing machine of the roller conveyor type is described in U.S. Pat. Nos. 3,025,779 and 3,545,971 and is simply referred herein to as "roller conveyor type processor". The roller conveyor type processor is based on four procedures (i.e., four steps), i.e., development, fixing, washing and drying. In the present invention, the roller conveyor type processor is most preferably based on these four procedures, other procedures (e.g., stop procedure) not exclusive. The washing can be effected in a two- or three-stage countercurrent washing system to save water.

The developing solution to be used in the present invention is preferably stored in a packaging material having a low oxygen permeability as described in JP-A-61-73147. The developing solution to be used in the present invention is preferably supplied by a replenishment system as described in JP-A-62-91939.

The silver halide photographic material of the present invention can provide a high Dmax and therefore can maintain a high density even if the half tone dot area is reduced when subjected to reduction processing after the formation of images.

The reducer to be used in the present invention is not specifically limited. For example, a reducer as described in Mees, *The Theory of the Photographic Process,* pp. 738–744 (Macmillan, 1954), Tetsuo Yano, *Shashin Shori to Shono Riron to Jissai,* pp. 166–169 (Kyoritsu Shuppan, 1978), and JP-A-50-27543, JP-A-52-68429, JP-A-55-17123, JP-A-55-79444, JP-A-57-142639 and JP-A-61-61155 can be used in the present invention. In particular, a reducer comprising as an oxidizing agent, a permanganate, a persulfate, ferric salt, a cupric salt, a secondary cerium salt, potassium ferricyanide, a bichromate, singly or in combination, and optionally an inorganic acid such as sulfuric acid and alcohols can be employed. Alternatively, a reducer comprising an oxidizing agent such as a potassium ferricyanide and ferric ethylenediaminetetraacetate, a silver halide solvent such as thiosulfate, thiocyanate, thiourea or derivatives thereof, and optionally an inorganic acid such as sulfuric acid can be used.

Typical examples of reducers which can be used in the present invention include the so-called Farmer's reducer, ferric ethylenediaminetetraacetate reducer, potassium permanganate reducer, ammonium persulfate reducer (Kodak R-5), and secondary cerium salt reducer.

The reduction is preferably finished within several seconds to scores of minutes normally at a temperature of from 10° to 40° C. and particularly within several seconds, at a temperature of 15° to 30° C. If the plate making light-sensitive material of the present invention is used, a sufficiently wide reduction tolerance can be obtained under these conditions.

The reducer is allowed to act on silver images formed in an emulsion layer through the upper light-insensitive layer containing the compound of the present invention.

In particular, this is accomplished by various methods. For example, the reducer is stirred while the plate making light-sensitive material is immersed therein. Alternatively, the reducer is provided on the surface of the plate making light-sensitive material by means of a brush, roller or the like.

A hydrazine derivative is employed in the process of the present invention and is preferably a compound represented by formula (I):

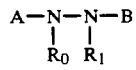

(I)

wherein A represents an aliphatic group or an aromatic group; B represents a formyl group, an acryl group, an alkyl or an acrylsulfonyl group, an alkyl or arylsulfinyl group, a carbamoyl group, an alkoxy or aryloxycarbonyl group, a sulfinamoyl group, an alkoxysulfonyl group, a thioacyl group, a thiocarbamoyl group or a heterocyclic group; and $R_0$ and $R_1$ each represents a hydrogen atom or one of $R_0$ and $R_1$ represents a hydrogen atom and the other represents a substituted or unsubstituted alkylsulfonyl group, a substituted or unsubstituted arylsulfonyl group or a substituted or unsubstituted acyl group, with the proviso that B, $R_1$ and the nitrogen atom to which they are bonded may together form a partial structure of a hydrazone, —N=C<.

In the formula (I), the aliphatic group represented by A has preferably from 1 to 30 carbon atoms and particularly preferably is a straight-chain, branched or cyclic alkyl group having from 1 to 20 carbon atoms. The branched alkyl group may be cyclized to form a saturated heterocyclic group containing one or more hetero atoms therein. The alkyl group may also contain one or more substituents such as an aryl group, an alkoxy group, a sulfoxy group, a sulfonamide group and a carbonamide group.

Examples of suitable alkyl groups include a t-butyl group, an n-octyl group, a t-octyl group, a cyclohexyl group, a pyrrolidyl group, an imidazolyl group, a tetrahydrofuryl group, and a morpholino group.

In the formula (I), the aromatic group represented by A is a monocyclic or bicyclic aryl group or unsaturated heterocyclic group. The unsaturated heterocyclic group may be condensed with a monocyclic or bicyclic aryl group to form a heteroaryl group.

Examples of suitable monocyclic or bicyclic aryl groups or unsaturated heterocyclic groups include a benzene ring, a naphthalene ring, a pyridine ring, a pyrimidine ring, an imidazole ring, a pyrrolazole ring, a quinoline ring, an isoquinoline ring, a benzimidazole ring, a thiazole ring, and a benzothiazole ring. Particularly preferred of these rings are those containing benzene rings.

Particularly preferred of the groups represented by A is an aryl group.

The aryl group or unsaturated heterocyclic group represented by A may contain one or more substituents. Typical examples of suitable substituents include straight-chain, branched or cyclic alkyl groups (preferably containing 1 to 20 carbon atoms), aralkyl groups (preferably monocyclic or bicyclic aralkyl groups containing 1 to 3 carbon atoms in the alkyl moiety), alkoxy groups (preferably containing 1 to 20 carbon atoms), substituted amino groups (preferably amino groups substituted by an alkyl group containing 1 to 20 carbon atoms), acylamino groups (preferably containing 2 to 20 carbon atoms), sulfonamide groups (preferably containing 1 to 30 carbon atoms), and ureido groups (preferably containing 1 to 30 carbon atoms).

In the formula (I), the group represented by A may comprise a ballast group commonly used for immobile photographic additives such as a coupler. The ballast group of the present invention is a relatively photographically inert group containing 8 or more carbon atoms. Such a ballast group can be selected from the group consisting of alkyl group, alkoxy groups, phenyl groups, alkylphenyl groups, phenoxy groups, and alkylphenoxy groups.

In the formula (I), the group represented by A may comprise a group which improves the adsorption thereof to the surface of silver halide grains. Examples of suitable adsorption groups include a thiourea group, heterocyclic thioamide groups, mercapto heterocyclic groups and triazole groups as described in U.S. Pat. Nos. 4,385,108, and 4,459,347, JP-A-59-195233, JP-A-59-200231, JP-A-59-201045, JP-A-59-201046, JP-A-59-201047, JP-A-59-201048, and JP-A-59-201049, and JP-A-60-179734, JP-A-61-170733 and Japanese Patent Application No. 60-19739.

In the formula (I), B represents a formyl group, an acyl group (e.g., acetyl, propionyl, trifluoroacetyl, chloroacetyl, benzoyl, 4-chlorobenzoyl, pyruvoyl, methoxalyl, methyloxamoyl), an alkylsulfonyl group (e.g., methanesulfonyl, 2-chloroethanesulfonyl), an arylsulfonyl group (e.g., benzenesulfonyl), alkylsulfinyl group (e.g., methanesulfinyl), an arylsulfinyl group (e.g., benzenesulfinyl), a carbamoyl group (e.g., methylcarbamoyl, phenylcarbamoyl), a sulfamoyl group (e.g., dimethylsulfamoyl), an alkoxycarbonyl group (e.g., methoxycarbonyl, methoxyethoxycarbonyl), an aryloxycarbonyl group (e.g., phenoxycarbonyl), a sulfinamoyl group (e.g., methylsulfinamoyl), an alkoxysulfonyl group (e.g., methoxysulfonyl, ethoxysulfonyl), a thioacyl group (e.g., methylthiocarbonyl), a thiocarbamoyl group (e.g., methylthiocarbamoyl) or a heterocyclic group (e.g., pyridine ring).

Particularly preferred of these groups represented by B are a formyl group and an acyl group.

In the formula (I), B may form a partial structure of hydrazone,

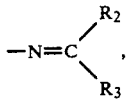

together with $R_1$ and the nitrogen atom to which B and $R_1$ are bonded.

In the above-mentioned formula, $R_2$ represents an alkyl group, an aryl group or a heterocyclic group. $R_3$ represents a hydrogen atom, an alkyl group, an aryl group or a heterocyclic group.

In the formula (I), $R_0$ and $R_1$ each represents a hydrogen atom, an alkylsulfonyl or arylsulfonyl group containing 20 or less carbon atoms (preferably a phenylsulfonyl group or a phenylsulfonyl group which is substituted such that the sum of the Hammett's substituent constants is −0.5 or more), or an acyl group containing 20 or less carbon atoms (preferably a benzoyl group, a benzoyl group which is substituted such that the sum of Hammett's substituent constants is −0.5 or more or a straight-chain, branched or cyclic substituted or unsubstituted aliphatic acyl group [examples of substituents include a halogen atom, an ether group, a sulfanomide group, and a sulfonic acid group ]). Particularly preferred of these groups represented by $R_0$ and $R_1$ is a hydrogen atom.

Specific examples of hydrazine derivatives are set forth below but the present invention is not to be construed as being limited thereto.

I-1

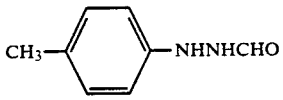

I-2

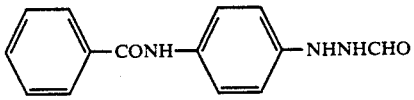

I-3

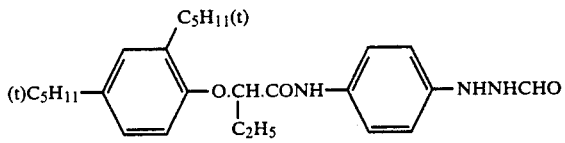

I-4

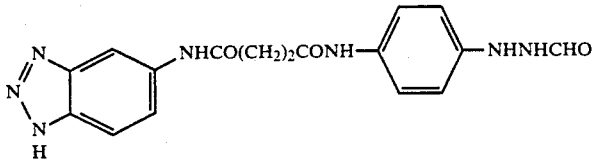

-continued
I-5
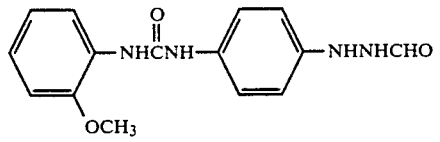
I-6
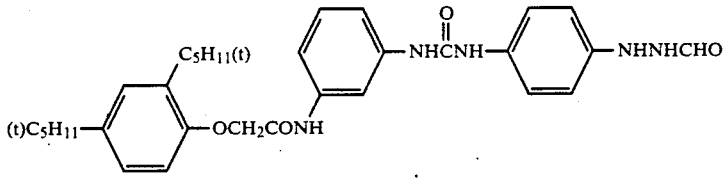
I-7
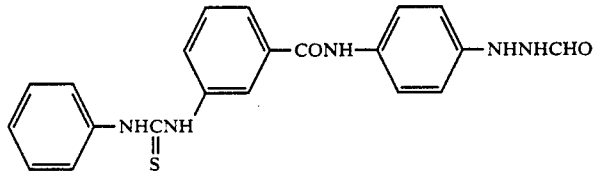
I-8
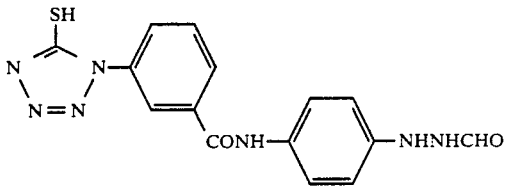
I-9
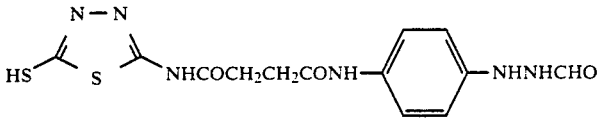
I-10
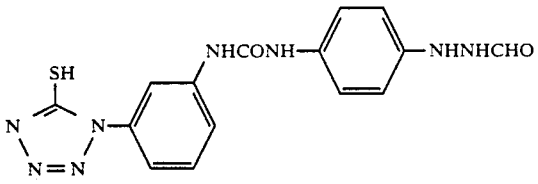
I-11
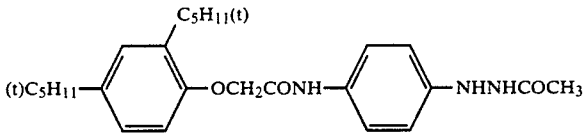
I-12
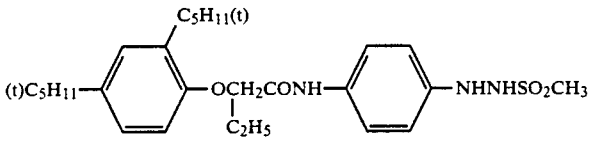
I-13
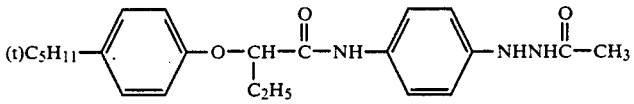
I-14
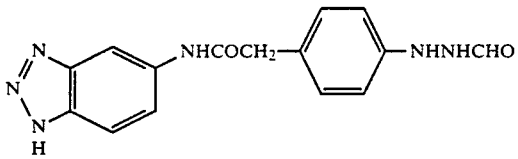

-continued

I-15

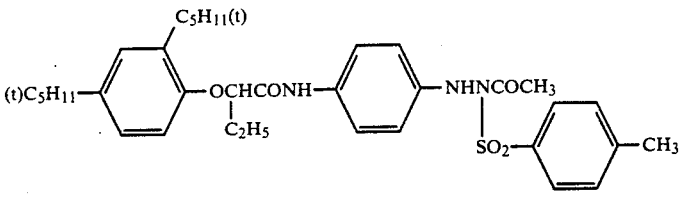

I-16

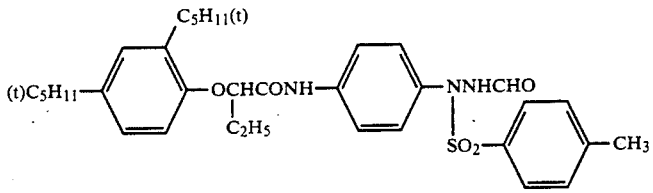

I-17

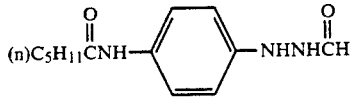

I-18

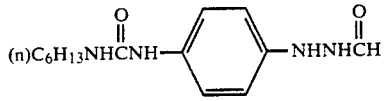

I-19

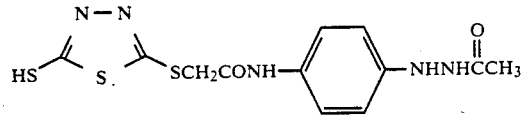

I-20

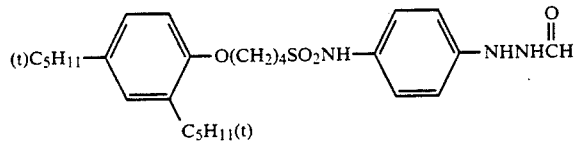

I-21

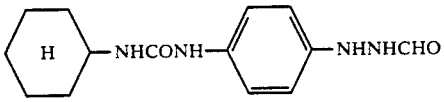

The hydrazine derivative is preferably incorporated in a silver halide emulsion layer in the photographic light-sensitive material The hydrazine derivative may be incorporated in other light-insensitive hydrophilic layers such as a protective layer, an intermediate layer, a filter layer and an antihalation layer. In particular, if the hydrazine compound to be used is water-soluble, it may be incorporated in a hydrophilic colloid solution in the form of an aqueous solution. If the hydrazine compound to be used is sparingly soluble in water, it may be incorporated in a hydrophilic colloid solution in the form of a solution in an organic solvent miscible with water such as an alcohol, an ester or a ketone. If the compound is incorporated in a silver halide emulsion layer, the incorporation may be effected at any time between the beginning of chemical ripening and before coating, preferably in the period of after the completion of chemical ripening and before coating. The compound is particularly preferably incorporated in a coating solution prepared for coating.

The optimum amount of the hydrazine derivative is preferably selected depending on the diameter of the silver halide grains, the halogen composition, the process and degree of chemical sensitization, the relationship between the layer in which the compound is incorporated and the silver halide emulsion layer, the type of antifoggant, and the like. Test methods for the selection of the optimum content of the compound are well known to those skilled in the art. In general, the amount of the hydrazine derivative employed is preferably in the range of from $1\times10^{-6}$ mol to $1\times10^{-1}$ mol and particularly preferably from $1\times10^{-5}$ to $4\times10^{-2}$ mol per mol of the silver halide.

The hydrazine derivative may be incorporated in a developing solution. The amount of the hydrazine derivative to be incorporated in the developing solution is preferably in the range of 5 mg to 5 g and particularly preferably 10 mg to 1 g per liter of the developing solution.

The silver halide photographic material to which the image forming process of the present invention is applied will be described hereafter.

The halogen composition of the silver halide emulsion to be used in the present invention is not specifically limited but may be any of silver chloride, silver bromochloride, silver bromoiodide, silver bromide and silver bromochloroiodide. The halogen composition has a silver iodide content of preferably 5 mol% or less and particularly preferably 3 mol% or less.

The silver halide grains contained in the photographic emulsion to be used in the present invention may have a relatively broad grain size distribution but preferably has a narrow grain size distribution. In particular, the size of grains is preferably such that 90% of the total grains by weight or number is within ±40% of the mean grain size. (Such an emulsion is generally called a monodisperse emulsion.)

The silver halide grains to be used in the present invention are finely divided grains having a grain size of preferably 0.7 μm or less and particularly preferably 0.4 μm or less.

Silver halide grains in the photographic emulsions may be so-called regular grains having a regular crystal form, such as a cubic form, and an octahedral form or those having an irregular crystal form such as a spherical form, and a tabular form, or those having a combination of these crystal forms.

The silver halide grains to be used in the present invention may have the same or different phases from the inside of to the surface layer of the grains.

A mixture of two or more silver halide emulsions separately prepared may be used, if desired.

During silver halide grain formation or physical ripening, a cadmium salt, sulfite, a lead salt, a thallium salt, an iridium salt or a complex thereof or a rhodium salt or a complex thereof may coexist in the system.

The silver halide emulsion of the present invention can be used without being chemically sensitized, i.e., as a primitive emulsion but is preferably subjected to chemical sensitization. The chemical sensitization of the silver halide emulsion can be accomplished by any suitable methods as described in H. Frieser, *Die Grundlagen der Photographischen Prosesse mit Silberhalogeniden,* Akademische Verlagsgesellschaft, 1968.

In particular, a sulfur sensitization process using a sulfur-containing compound capable of reacting with silver (e.g., thiosulfate, thiourea, a mercapto compound, rhodanine) or active gelatin, a reduction sensitization process using a reducing substance (e.g., a stannous salt, an amine, a hydrazine derivative, formamidinesulfinic acid, a silane compound), or a noble metal sensitization process using a noble metal compound (e.g., a gold complex, a complex of the group VIII metals such as Pt, Ir, Pd) may be used, alone or in combination.

As a binder or protective colloid to be incorporated in the emulsion layer or intermediate layers in the light-sensitive material used in the present invention, gelatin can be advantageously used. In addition to gelatin, hydrophilic colloids can also be used.

Examples of suitable hydrophilic colloids which can be used in the present invention include proteins such as gelatin derivatives, graft polymers of gelatin with other high molecular weight compounds, albumin, and casein; saccharide derivatives such as hydroxyethyl cellulose, carboxymethyl cellulose, cellulose ester sulfate, sodium alginate, and starch derivatives; homopolymers or copolymers such as polyvinyl alcohol, polyvinyl alcohol partial acetal, poly-N-vinyl pyrrolidone, polyacrylic acid, polymethacrylic acid, polyacrylamide, polyvinyl imidazole, and polyvinyl pyrazole; and various other synthetic hydrophilic high molecular weight compounds.

As gelatin, acid-treated gelatin or enzyme-treated gelatin as described in *Bull. Soc. Sci. Phot. Japan,* No. 16, page 30 (1966) may be used in addition to lime-treated gelatin. Alternatively, the hydrolyzates or enzymatic decomposition products of gelatin may be used.

The photographic emulsion may be subjected to spectral sensitization with a methine dye or the like. Examples of suitable dyes include cyanine dyes, merocyanine dyes, composite cyanine dyes, composite merocyanine dyes, holopolar cyanine dyes, hemicyanine dyes, styryl dyes and hemioxonol dyes. Particularly preferred of these dyes are cyanine dyes, merocyanine dyes and composite merocyanine dyes. These dyes may be used in combination to provide a supersensitizing effect, if desired.

The photographic emulsion may comprise a dye which itself does not have a spectral sensitizing effect or a substance which does not substantially absorb visible light but exhibits a supersensitizing effect together with the above-described sensitizing dye. Examples of such dyes or substances which may be incorporated in the emulsion include aminostyryl compounds substituted with nitrogen-containing heterocyclic groups as described in U.S. Pat. Nos. 2,933,390 and 3,635,721, aromatic organic acid-formaldehyde condensates as described in U.S. Pat. No. 3,743,510, cadmium salts and azaindene compounds. Combinations as described in U.S. Pat. Nos. 3,615,613, 3,615,641, 3,617,295 and 3,635,721 are particularly useful.

The photographic emulsion may comprise various compounds for the purpose of inhibiting fog during the preparation, preservation or photographic processing of the light-sensitive material or stabilizing the photographic properties thereof. Examples of such compounds which may be incorporated in the photographic emulsion include many compounds known as antifoggants or stabilizers such as azoles, e.g., benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particularly 1-phenyl-5-mercaptotetrazole); mercaptopyrimidines; mercaptotriazines; thioketo compounds, e.g., oxazolinethione; azaindenes, e.g., triazaindenes, tetraazaindenes (particularly 4-hydroxy-substituted (1,3,3*a*,7)tetraazaindenes), pentaazaindenes; benzenesulfonic acid; benzenesulfinic acid; and benzenesulfonic acid amide.

Particularly preferred of these compounds are benzotriazoles (e.g., 5-methylbenzotriazole) and nitroindazoles (e.g., 5-nitroindazole). These compounds may be incorporated in the processing solutions, if desired.

The photographic light-sensitive material of the present invention may comprise an inorganic or organic film hardener in the photographic emulsion layer or other hydrophilic colloid layers. For example, chromium salts (e.g., chromium alum, chromium acetate), aldehydes (e.g., formaldehyde, glyoxal, glutaraldehyde), N-methylol compounds (e.g., dimethylol urea, methyloldihydroxydioxane), dioxane derivatives (e.g., 2,3-dihydroxydioxane), active vinyl compounds (e.g., 1,3,5-triacryloyl-hexahydro-s-triazine, 1,3-vinylsulfonyl-2-propanol), active halogen compounds (e.g., 2,4-dichloro-6-hydroxy-s-triazine), mucohalogenic acids (e.g., mucochloric acid, mucophenoxychloric acid), and the like can be used alone or in combination.

The photographic emulsion layer or other hydrophilic colloid layers in the light-sensitive material may comprise any type of surface active agents for the purpose of facilitating coating and emulsion dispersion, inhibiting static property and adhesion, improving sliding property and photographic properties (e.g., acceleration of development, higher contrast, sensitization) or like purposes.

Examples of suitable surface active agents include nonionic surface active agents such as saponin (steroid series), alkylene oxide derivatives (e.g., polyethylene glycol, polyethylene glycol/polypropylene glycol condensates, polyethylene glycol alkyl ethers or polyethylene glycol alkylaryl ethers, polyethylene glycol esters, polyethylene glycol sorbitan esters, polyalkylene glycol alkylamines or amides, polyethylene oxide addition products of silicone), glycidol derivatives (e.g., polyglyceride alkenylsuccinates, alkylphenol polyglycerides), aliphatic esters of polyvalent alcohols, or alkylesters of saccharides; anionic surface active agents containing acid groups such as a carboxyl group, a sulfo group, a phospho group, a sulfuric acid ester group or a phosphoric acid ester group (e.g., alkylcarboxylates, alkylsulfonates, alkylbenzenesulfonates, alkylnaphthalenesulfonates, alkylsulfuric esters, alkylphosphoric esters, N-acyl-N-alkyltaurines, sulfosuccinic esters, sulfoalkyl-polyoxyethylenealkylphenylethers, polyoxyethylenealkylphosphoric esters); amphoteric surface active agents such as amino acids, aminoalkylsulfonic acids, aminoalkylsulfuric or phosphoric esters, alkylbetaine and amine oxides; and cationic surface active agents such as alkylamine salts, aliphatic or aromatic quaternary ammonium salts, heterocyclic quaternary ammonium salts (e.g., pyridinium, imidazolium), and aliphatic or heterocyclic group-containing phosphonium or sulfonium salts.

The surface active agent which can be particularly preferably used is a polyalkylene oxide having a molecular weight of 600 or more as described in JP-B-58-9412 (The term "JP-B" as used herein means an "examined Japanese patent publication").

The photographic emulsion layer or other hydrophilic colloid layers of the photographic light-sensitive material may comprise a dispersion of a synthetic polymer insoluble or sparingly soluble in water, for the purpose of improving dimensional stability. Examples of such a synthetic polymer include alkyl(meth)acrylates, alkoxyalkyl(meth)acrylates, glycidyl(meth)acrylates, (meth)acrylamides, vinylesters (e.g., vinyl acetate), acrylonitrile, olefine, styrene, alone or in combination, and polymers comprising as monomer components combinations of these compounds with acrylic acid, methacrylic acid, $\alpha,\beta$-unsaturated dicarboxylic acids, hydroxylalkyl(meth)acrylates, sulfoalkyl(meth)acrylates, styrenesulfonic acid or the like.

The silver halide to be incorporated in a light-sensitive material (printing paper) comprising paper as a support is not specifically limited but is preferably a monodisperse silver halide emulsion.

The silver halide composition to be used may be a mixed silver halide such as silver bromochloride, silver bromochloroiodide and silver bromoiodide in addition silver chloride and silver bromide.

The silver halide grains may have a crystal structure in which the silver halide composition is uniform from the surface to the internal portion thereof or differs from the surface to the internal portion thereof. Alternatively, the silver halide grains may be a so-called conversion type as described in British Patent 635,841 and U.S. Pat. No. 3,622,318.

The silver halide emulsion may be of the surface latent image type in which latent images are formed mainly on the surface of grains or the internal latent image type in which latent images are formed mainly in the internal portion of grains or may be a mixture thereof. A silver halide emulsion of the internal latent image type can comprise an appropriate nucleating agent or a light fogging agent to act as a direct positive emulsion.

During the formation of the silver halide grains or physical ripening, cadmium salts, zinc salts, lead salts, thallium salts, iridium salts, rhodium salts, iron salts or the like can be present. Particularly preferred of these salts are rhodium salts. Examples of such rhodium salts include water-soluble trivalent rhodium-halogen complex compounds, for example, hexachlororhodium (III) acid or salts thereof (e.g., ammonium salts, sodium salts, potassium salts). If such a rhodium salt is used in relatively large amount, the light-sensitive material becomes capable of being handled under room light from which ultraviolet light is removed. On the other hand, if the rhodium salt is used in relative small amount, the light-sensitive material can be provided with high contrast characteristics.

The silver halide emulsion can be subjected to chemical sensitization such as normal sulfur sensitization, selenium sensitization, reduction sensitization and noble metal sensitization, singly or in combination.

The silver halide emulsion can be subjected to spectral sensitization with a spectral sensitizing dye.

The silver halide emulsion layer or other layers may comprise as a development accelerator a compound as described in U.S. Pat. Nos. 3,288,612, 3,333,959, 3,345,175 and 3,708,303, British Patent 1,098,748, and West German Patents 1,141,531, and 1,183,784.

The hydrazine derivative as mentioned above may also be incorporated in a silver halide light-sensitive material comprising a support coated with a polyolefin to provide superhigh contrast.

Furthermore, a tetrazolium compound as described in JP-A-52-18317, JP-A-53-17719, JP-A-53-17720, JP-A-59-228645, JP-A-60-31134 and JP-A-59-231527 can be incorporated in the silver halide light-sensitive material to provide high contrast.

Moreover, a condensate of a polyalkylene oxide compound comprising at least 10 units of polyalkylene oxides such as alkylene oxides having 2 to 4 carbon atoms (e.g., ethylene oxide, propylene-1,2-oxide, butylene-1,2-oxide) and preferably of ethylene oxide, with a compound containing at least one active hydrogen atom such as water, an aliphatic alcohol, an aromatic alcohol, an aliphatic acid, an organic amine and a hexytol derivative or a block copolymer of two or more polyalkylene oxides can be used.

Anti-foggants, surface active agents, film hardeners, binders, matting agents, water-insoluble synthetic polymer dispersions, and other additives as described with reference to the silver halide light-sensitive materials comprising the hydrazine derivatives as described above can be used.

Examples of suitable paper materials for the support include baryta paper, and raw paper coated with polyolefin on one side or both sides thereof.

The effects of the present invention appear markedly when raw paper coated with polyolefin on both sides thereof is used.

Examples of polyolefin resins to be coated on raw paper include polymers of $\alpha$-olefins such as polyethylene and polypropylene, and mixtures of these various polymers. Particularly preferred polyolefins are high density polyethylene, low density polyethylene, and mixtures thereof. These polyolefins are normally coated on both sides of raw paper using an extrusion coating method. Therefore, the molecular weight of these polyolefins is not specifically limited, so long as they can be extrusion-coated, but is normally in the range of $1\times10^4$ to $1\times10^6$.

The thickness of the polyolefin coat layer is not specifically limited and can be selected in accordance with that of the polyolefin coated layer on a support for a conventional photographic paper. In general, the thickness of the polyolefin coated layer is preferably in the range of 10 to 50 μm.

The polyolefin coated layer on the image side of the support, i.e., the side on which the photographic emulsion is coated preferably contains a white pigment. The type and amount of the white pigment can be appropriately selected in a known manner. The polyolefin coated layer can further contain known additives such as fluorescent brightening agents and oxidation inhibitors.

The polyolefin coated layer on the opposite side can comprise the above-mentioned polyolefin resin and can further contain a coloring pigment, a white pigment and the like. The polyolefin coated layer on this side can further contain the same additives as in the polyolefin coated layer on the other side.

The extrusion coating of the polyolefin resin can be accomplished using conventional polyolefin extruders and laminators.

Prior to the coating of a silver halide emulsion layer on the polyolefin coated layer, the polyolefin coated layer is preferably subjected to a corona discharge treatment, a glow discharge treatment, a flame treatment or the like. A subbing layer or an antihalation layer may be then optionally provided on the polyolefin coated layer thus treated.

One or more silver halide emulsion layers can be provided on the polyolefin coated layer.

In order to obtain photographic images, the exposure of the light-sensitive material can be accomplished by any commonly used method. In particular, various known light sources such as natural light (sunshine), tungsten light, mercury vapor lamp, xenon arc lamp, carbon arc lamp, xenon flash lamp, cathode ray tube, flying spot, emission diode, laser light such as gas laser (e.g., argon laser, He-Ne laser), dye laser, YAG laser and semi-conductor laser can be used. Also, light which is released from a fluorescent substance excited by electron ray, X-ray, γ-ray or α-ray can be used. It goes without saying that the exposure time ranges from 1/1000 second to 1 second, which range is commonly used in cameras. In the present invention, the exposure time may be shorter than 1/1000 second, e.g., $1/10^4$ to $1/10^8$ second from a xenon flash lamp or cathode ray tube or longer than 1 second.

The spectral composition of light to be used for exposure can be adjusted with a color filter, if desired.

The present invention is further described in greater detail in the following examples, but the present invention should not be construed as being limited thereto. Unless otherwise indicated herein, all parts, percents ratios, and the like are by weight.

EXAMPLE 1

An aqueous solution of silver nitrate and an aqueous solution of potassium iodide and potassium bromide were simultaneously added to an aqueous solution of gelatin which had been kept at a temperature of 50° C. in the presence of iridium(III) potassium hexachloride in an amount of $4\times10^{-7}$ per mol of silver and of ammonium in 60 minutes while the pAg thereof was kept at 7.8. Thus, a monodisperse emulsion of cubic grains having a mean silver iodide content of 0.3 mol% was prepared. The emulsion thus prepared was then desalted in a flocculation process. Inert gelatin was then added to the emulsion in an amount of 40 g per mol of silver. The emulsion was then kept at a temperature of 50° C. 5,5'-Dichloro-9-ethyl-3,3'-bis-(3-sulfopropyl)oxacarbocyanine was added to the emulsion. A solution of potassium iodide was also added to the emulsion in an amount of $1\times10^{-3}$ mol per mol of silver. After 15 minutes, the emulsion was then allowed to cool down. The emulsion was then redissolved. At a temperature of 40° C., the following compounds were added to the emulsion.

Methylhydroquinone (0.02 mol/mol Ag) Sensitizing dye of the formula:

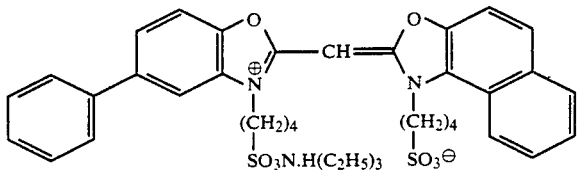

(0.02 mol/mol Ag)

Hydrozine derivative of the formula:

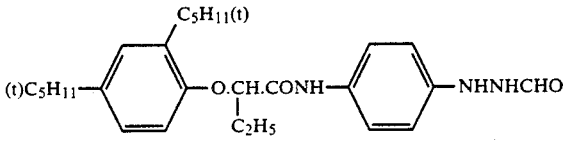

($1.2\times10^{-3}$ mol/mol Ag

Compound of the formula:

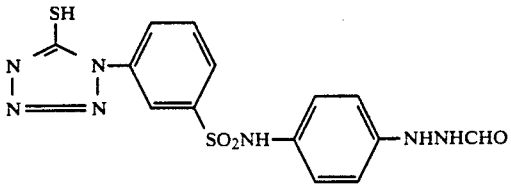

($0.5\times10^{-4}$ mol/mol Ag)

5-Methylbenztriazole 4-Hydroxy-6-methyl-1,3,3a,7-tetraazaindene Compound of the formula (a):

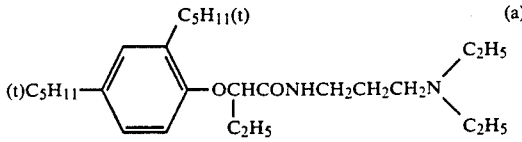

Compound of the formula (b):

(b)

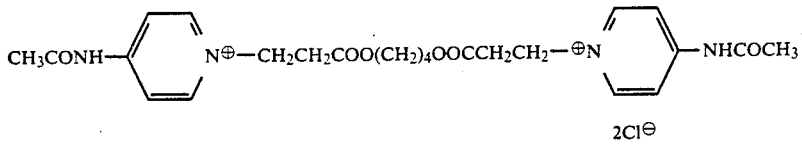

Dispersion of polyethylacrylate Gelatin hardener of the formula:

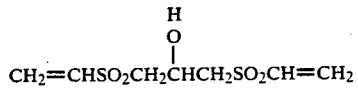

The material was then coated on a polyethylene terephthalate film in such an amount that the amount of silver reached 3.4 g/m$^2$, 1.5 g/m$^2$ of gelatin, 50 g/m$^2$ of polymethyl methacrylate having a grain size of 2.5 μm and 0.15 g/m$^2$ of methanol silica (i.e., methyl silicate) were coated on the emulsion layer as protective layer. At the same time, a layer containing as coating aids a fluorinated surface active agent of the formula:

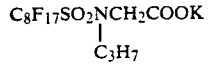

and sodium dodecylbenzenesulfonate was coated on the emulsion layer. The film thus obtained was designated "Film A".

For comparison, Film B was prepared in the same manner as Film A except that the hydrazine derivative was not incorporated in the material.

These films were then exposed to light through a 150-line magenta contact screen and a exposure wedge for sensitometry, developed with a developing solution of the composition described below a temperature of 34° C. for 30 seconds, fixed, washed with water, and dried. (This processing was effected using an automatic developing machine FG 660F produced by Fuji Photo Film Co., Ltd.)

Another batch of these films were totally exposed to light on half of the paper (size: 50.8 cm×61.0 cm) and then developed with Developing Solution A, B, C and D set forth in Table 1, respectively. This running processing was effected at a rate of 200 sheets a day over a 5 day period while each developing solution was replenished at a rate of 100 ml per sheet processed. The photographic properties and silver stain of these samples were then evaluated.

In order to examine a silver halide light-sensitive material comprising a paper support for color stain, a photographic paper PL.200WP produced by Fuji Photo Film Co., Ltd. was developed, fixed, and then dried.

The sensitivity of the samples is represented in Table 2 relative to the reciprocal of the exposure required to obtain a density of 1.5 when Film A is processed with the Developing Solution A as 100.

$\overline{G}$ indicates the tan $\theta$ of the line between the density 0.3 and the density 3.0 on the characteristic curve. The half tone dot quality was visually evaluated in five stages. Quality "5" is the best quality, and Quality "1" is the worst quality. Qualities "5" and "4" are practicable for half tone dot plates for use in plate making. Quality "3" is poor but is the lower practicable limit. Qualities "2" and "1" are impractical.

For the evaluation of silver stain, a condition where no silver stain is developed on a 9.0×25.0 cm film is evaluated as "5", and a condition where silver stain is developed on the overall surface of the film is evaluated as "1". Condition "4" indicates that silver stain is developed slightly partially on the surface of the film cut is acceptable in practical use. Condition "3" and lower conditions are impractical.

Silver halide light-sensitive material PL.200WP comprising a paper support was visually evaluated for color stain as follows:

E: No remarkable color stain observed

F: Color stain slightly observed

P: Color stain so remarkably observed that commercial value is destroyed.

TABLE 2

| | Developing Solution | | | |
|---|---|---|---|---|
| | A | B | C | D |
| Hydroquinone | 50.0 g | 50.0 g | 50.0 g | 50.0 g |
| N-Methyl-p-aminophenol | 0.3 g | 0.3 g | 0.3 g | 0.3 g |
| Sodium hydroxide | 18.0 g | 18.0 g | 18.0 g | 18.0 g |
| 5-Sulfosalicylic acid | 45.0 g | 45.0 g | 45.0 g | 45.0 g |
| Boric acid | 10.0 g | 10.0 g | 10.0 g | 10.0 g |
| Potassium sulfite | 110.0 g | 110.0 g | 110.0 g | 110.0 g |
| Disodium ethylenediamine tetraacetate | 1.0 g | 1.0 g | 1.0 g | 1.0 g |
| Potassium bromide | 10.0 g | 10.0 g | 10.0 g | 10.0 g |
| 5-Methylbenzotriazole | 0.4 g | 0.4 g | 0.4 g | 0.4 g |
| 2-Mercaptobenzimidazole-5-sulfonic acid | 0.3 g | 0.3 g | 0.3 g | 0.3 g |
| 3-(5-Mercaptotetrazole)-benzenesulfonic acid | 0.2 g | 0.2 g | 0.2 g | 0.2 g |
| Sodium p-toluenesulfonate | 15.0 g | 15.0 g | 15.0 g | 15.0 g |
| 3-Diethylamino-1,2-propanediol | 25.0 g | 0 g | 0 g | 0 g |
| N-n-Butyldiethanolamine | — | 16.0 g | — | — |
| 6-Dimethylamino-1-hexanol | — | — | 4.0 g | — |
| Water to make | 1 l | 1 l | 1 l | 1 l |
| pH adjusted with potassium hydroxide to | 11.6 | 11.6 | 11.6 | 11.6 |

The results obtained are set forth in Table 3 below.

TABLE 3

| Developer Used | Example Type | Light-Sensitive Material | Property of Fresh Solution | | | | | Properties Obtained after 5-day Running of 1000 Sheets of Film Sample | | | | |
|---|---|---|---|---|---|---|---|---|---|---|---|---|
| | | | Sensitivity | $\overline{G}$ | Half Tone Dot Quality | Silver Stain | Color Stain | Sensitivity | $\overline{G}$ | Half Tone Dot Quality | Silver Stain | Color Stain |
| Developer A | Comparison | Film A | 100 | 18 | 5 | 5 | E | 100 | 18 | 5 | 3 | E |
| " | " | Film B | 20 | 3 | 1 | 5 | E | 20 | 3 | 1 | 3 | E |
| " | " | PL 200 WP | | | | 5 | F | | | | 3 | F |
| Developer B | Comparison | Film A | 100 | 18 | 5 | 5 | E | 100 | 18 | 5 | 5 | E |
| " | " | Film B | 20 | 3 | 1 | 5 | E | 20 | 3 | 1 | 5 | E |

TABLE 3-continued

| Developer Used | Example Type | Light-Sensitive Material | Property of Fresh Solution: Sensitivity | $\overline{G}$ | Half Tone Dot Quality | Silver Stain | Color Stain | Properties Obtained after 5-day Running of 1000 Sheets of Film Sample: Sensitivity | $\overline{G}$ | Half Tone Dot Quality | Silver Stain | Color Stain |
|---|---|---|---|---|---|---|---|---|---|---|---|---|
| " | " | PL 200 WP | | | | 5 | P | | | | 5 | P |
| Developer C | Invention | Film A | 100 | 18 | 5 | 5 | E | 100 | 18 | 5 | 5 | E |
| " | Comparison | Film B | 20 | 3 | 1 | 5 | E | 20 | 3 | 1 | 5 | E |
| " | Invention | PL 200 WP | | | | 5 | E | | | | 5 | E |
| Developer D | Comparison | Film A | 40 | 6 | 2 | 5 | E | 40 | 6 | 2 | 5 | E |
| " | " | Film B | 20 | 3 | 1 | 5 | E | 20 | 3 | 1 | 5 | E |
| " | " | PL 200 WP | | | | 5 | E | | | | 5 | E |

Film A containing the hydrazine derivative exhibits a high sensitivity, a high $\overline{G}$ and a high half tone dot quality when developed with Developing Solutions A, B and C comprising an amino compound. However, when the developing solution comprising 3-diethylamino-1,2-propanediol as an amino compound is used in the running process, remarkable silver stain is developed. Furthermore, if a light-sensitive material comprising a paper support is processed under this condition, a slight color stain is observed on the material. When the developing solution comprising N-n-butyldiethanolamine as an amino compound is used in the running process, no silver stain is observed but remarkable color stain is developed on a light-sensitive material comprising a paper support. On the other hand, when the Developing Solution C comprising the present amino compound is used in running process, no silver stain is developed and no remarkable color stain is developed on a light-sensitive material comprising a paper support.

In other words, the present process enables a light-sensitive material comprising a hydrazine derivative to exhibit a high sensitivity, a high G and an excellent half tone dot quality. When the light-sensitive material is processed in a running operation, no silver stain is developed. Furthermore, no color stain is developed on a light-sensitive material comprising a paper support under this condition.

Furthermore, when a developing solution comprising 4-dimethylamino-1-butanol or 8-dimethylamino-1,2 octanediol instead of 6-dimethylamino-1-hexanol is used, silver stain is less developed than with the comparative Developing solutions B and C. Furthermore, color stain is less developed on a paper support of photographic paper than with the Developing Solutions B and C.

EXAMPLE 2

The film samples thus prepared were developed with the following Developing Solutions E and F at a temperature of 34° C. over a 30 second period.

TABLE 4

| | Developer E | Developer F |
|---|---|---|
| Hydroquinone | 50.0 g | 50.0 g |
| N-Methyl-p-aminophenol $\frac{1}{2}H_2SO_4$ | 0.3 g | 0.3 g |
| Sodium hydroxide | 18.0 g | 18.0 g |
| 5-Sulfosalicylic acid | 25.0 g | 25.0 g |
| Boric acid | 25.0 g | 25.0 g |
| Potassium sulfite | 110.0 g | 110.0 g |
| Disodium ethylenediaminetetra-acetate | 1.0 g | 1.0 g |
| Potassium bromide | 10.0 g | 10.0 g |
| 5-Methylbenzotriazole | 0.5 g | 0.5 g |
| 2-Mercaptobenzimidazole-5-sulfonic acid | 0.2 g | 0.2 g |
| 3-(5-Mercaptotetrazole)-benzenesulfonic acid | 0.2 g | 0.2 g |
| Sodium p-toluenesulfonate | 15.0 g | 15.0 g |
| 6-Dimethylamino-1-hexanol | 4.0 g | 2.0 g |

TABLE 4-continued

| | Developer E | Developer F |
|---|---|---|
| N-n-butyldiethanolamine | — | 8.0 g |
| Water to make | 1 l | 1 l |
| pH adjusted with potassium hydroxide | 11.7 | 11.7 |

Fixing solution GR-R1 produced by Fuji Photo Film Co., Ltd. was used as a fixing solution. These film samples were then washed with water and dried. This processing was effected by means of an automatic developing machine FG680A, produced by Fuji Photo Film Co., Ltd. The following various light-sensitive material samples were then exposed to light through these film samples.

Fuji Camera Contact Film GA-100
Fuji Camera Contact Film FA-100
Fuji Contact Film VU-100
Fuji Contact Film HU-100
Fuji Contact Film HU-S100
Fuji Panchromatic Film GP-100
Fuji Lith Contact Film KR-100
Fuji Lith Duplicating Film DR-100
Fuji Photographi Paper PL-100WP
Fuji Photo Type Setting Paper PH100WP
Fuji Computer Photographic Film PB-100
Fuji Pagination Film XD-100
Fuji Scanner Film LS.555
Fuji Scanner Film KS.5000
Fuji Scanner Film LS.4000
Fuji Projection Duplicating Film PDO-100
Fuji Lith Contact Film KUV-100M
Fuji Lith Contact Film KUH-100
Fuji Lith Duplicating Film DU-100
Fuji Lith Stripping Film SU The results obtained are set forth in Table 5 below. The criteria for evaluation were the same as in Example 1. However, for light-sensitive materials which exhibit a low maximum blackening density, $\overline{G}$ indicates the tan $\theta$ of the line between the density 0.1 and the density 1.0 on the characteristic curve.

TABLE 5

| | Developer E: $\overline{G}$ | Developer E: Color Stain | Developer F: $\overline{G}$ | Developer F: Color Stain |
|---|---|---|---|---|
| Fuji Camera Contact Film GA-100 | 16 | E | 16 | E |
| Fuji Camera Contact Film FA-100 | 13 | E | 13 | E |
| Fuji Contact Film VU-100 | 17 | E | 17 | E |
| Fuji Contact Film HU-100 | 12 | E | 12 | E |
| Fuji Contact Film HU-S100 | 9.0 | E | 9.0 | E |
| Fuji Panchromatic Film GP-100 | 18 | E | 18 | E |
| Fuji Lith Contact Film KR-100 | 6.5 | E | 6.5 | E |
| Fuji Lith Duplicating Film DR-100 | 4.8 | E | 4.8 | E |
| Fuji Photographic Paper PL-100WP | 2.3 | E | 2.3 | F |
| Fuji Photo Type Setting Paper | 2.5 | E | 2.5 | F |

TABLE 5-continued

| | Developer E | | Developer F | |
|---|---|---|---|---|
| | G | Color Stain | G | Color Stain |
| PH100WP | | | | |
| Fuji Computer Photographic Film PB-100 | 3.1 | E | 3.1 | E |
| Fuji Pagination Film XD-100 | 5.8 | E | 5.8 | E |
| Fuji Scanner FIlm LS.555 | 5.4 | E | 5.4 | E |
| Fuji Scanner Film LS.5000 | 6.3 | E | 6.3 | E |
| Fuji Scanner Film LS.4000 | 5.6 | E | 5.6 | E |
| Fuji Projection Duplicating Film PDO-100 | 4.5 | E | 4.5 | E |
| Fuji Lith Contact Film KUV-100M | 7.0 | E | 7.0 | E |
| Fuji Lith Contact Film KUH-100 | 6.5 | E | 6.5 | E |
| Fuji Lith Duplicating Film DU-100 | 3.5 | E | 3.5 | E |
| Fuji Lith Stripping Film SU | 5.3 | E | 5.3 | E |

The results in Table 5 show that the present Developing Solution E causes less color stain on all the samples.

On the other hand, Developing Solution F comprising the present amino compound and a conventional amino compound provides substantially excellent results with a lightly poorer evaluation in color stain than the Developing Solution E.

While the invention has been described in detail and with reference to specific embodiments thereof, it will be apparent to one skilled in the art that various changes and modifications can be made therein without departing from the spirit and scope thereof.

What is claimed is:

1. A method for processing an image-wise exposed silver halide photographic material which comprises developing said exposed silver halide photographic material in the presence of a hydrazine derivative, wherein the processing is effected with a watersoluble alkaline developing solution having a pH of 10.5 to 12.3 and containing the following components (1) to (3):

(1) a dihydroxybenzene developing agent;

(2) a sulfite preservative in an amount of 0.3 mol/l or more; and (3) a compound represented by formula (X) in an amount of from 0.005 to 0.30 mol/l:

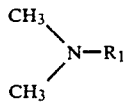

(X)

wherein $R_1$ represents a hydroxylalkyl group having from 4 to 10 carbon atoms.

2. The method for processing a silver halide photographic material as claimed in claim 1, wherein the developing solution contains (1) said dihydroxybenzene developing agent and (2) as an auxiliary developing agent, a p-aminophenol developing agent, 3-pyrazolidone developing agent or a mixture thereof.

3. The method for processing a silver halide photographic material as claimed in claim 1, wherein the hydrazine derivative is represented by formula (I):

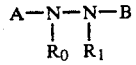

(I)

wherein A represents an aliphatic group or an aromatic group; B represents a formyl group, an acyl group, an alkyl or arylsulfonyl group, an alkyl or arylsulfinyl group, a carbamoyl group, an alkoxy group or aryloxycarbonyl group, a sulfinamoyl group, an alkoxysulfonyl group, a thioacyl group, a thiocarbamoyl group, or a heterocyclic group; and $R_0$ and $R_1$ each represents a hydrogen atom or one of $R_0$ and $R_1$ represents a hydrogen atom and the other represents a substituted or unsubstituted alkylsulfonyl group, a substituted or unsubstituted arylsulfonyl group or a substituted or unsubstituted acyl group, with the proviso that b, $R_1$ and the nitrogen atom to which they are bonded may together form a partial structure of a hydrazone, —N=C<.

4. The method for processing a silver halide photographic material as claimed in claim 1, wherein the hydrazine derivative represented by formula (I) is present in the developing solution.

5. The method for processing a silver halide photographic material as claimed in claim 1, wherein the hydrazine derivative represented by formula (I) is present in the silver halide photographic material.

6. The method for processing a silver halide photographic material as claimed in claim 1, wherein the silver halide photographic material is a material including a paper support.

7. The method for processing a silver halide photographic material as claimed in claim 1, wherein the developing solution additionally contains at least one of a compound represented by the formula (Y) and a compound represented by the formula (Z)

$$R_5—SO_3M \quad (Y)$$

$$R_6—COOM \quad (Z)$$

wherein M represents H, Na, K or $NH_4$; and $R_5$ and $R_6$ each represents an alkyl group, an alkyl benzene group or a benzene group, wherein the alkyl group and the alkyl moiety of the alkyl benzene group contains 3 or more carbon atoms.

8. The method for processing a silver halide photographic material as claimed in claim 1, wherein the method additionally includes fixing said photographic material and washing and/or stabilizing said photographic material.

* * * * *